United States Patent [19]

Yoneda

[11] Patent Number: 4,509,318

[45] Date of Patent: Apr. 9, 1985

[54] STEEL CORD

[75] Inventor: Osamu Yoneda, Miki, Japan

[73] Assignee: Tokusen Kogyo Kabushiki Kaisha, Ono, Japan

[21] Appl. No.: 576,922

[22] Filed: Feb. 3, 1984

[30] Foreign Application Priority Data

Feb. 10, 1983 [JP] Japan ..... 58-18628[U]

[51] Int. Cl.[3] ..... D07B 1/06; D07B 1/10

[52] U.S. Cl. ..... 57/212; 57/218; 57/219; 57/902

[58] Field of Search ..... 57/212, 213, 215, 218, 57/219, 236, 237, 902, 3, 6, 9; 152/359

[56] References Cited

U.S. PATENT DOCUMENTS

| | | | |
|---|---|---|---|
| 2,359,090 | 9/1944 | Dyer | 57/212 X |
| 2,492,352 | 12/1949 | Bourdon | 57/902 X |
| 2,598,033 | 9/1952 | Bourdon | 57/212 |
| 3,455,100 | 7/1969 | Sidles et al. | 57/902 X |
| 3,538,702 | 10/1970 | Wolf et al. | 57/902 X |
| 3,911,622 | 10/1975 | Fenner | 152/359 X |
| 4,022,009 | 5/1977 | Van Assendelft | 57/902 X |
| 4,030,248 | 6/1977 | Van Assendelft | 57/902 X |
| 4,176,513 | 12/1979 | Young et al. | 57/237 |
| 4,349,063 | 9/1982 | Kikuchi et al. | 57/902 X |
| 4,430,851 | 2/1984 | Sundet | 57/902 X |

FOREIGN PATENT DOCUMENTS

| | | | |
|---|---|---|---|
| 2080845 | 2/1982 | United Kingdom | 57/213 |

*Primary Examiner*—Donald Watkins

*Attorney, Agent, or Firm*—Wenderoth, Lind & Ponack

[57] ABSTRACT

A steel cord composed of four material wires of the same diameter twisted together, of which two material wires are stuck together and intertwisted at the center and each of the other two material wires is arranged on both sides of the former two material wires with a certain space left between the former and the latter. The latter two material wires are twisted about the former two material wires in the same twist direction and at the same pitch as the former two material wires into a steel cord. The steel cord thus composed facilitates infiltration of a rubber compound into the central part of the steel cord, ensures perfect adhesion between the rubber compound and the steel cord, checks elongation under a very low load, stabilizes twist construction in the lengthwise direction and improves an anti-fatigue characteristic.

2 Claims, 8 Drawing Figures

Fig. 1A
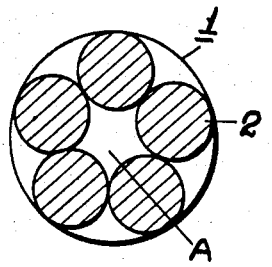
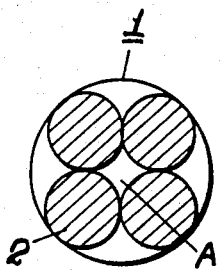
Fig. 1B
Fig. 2A
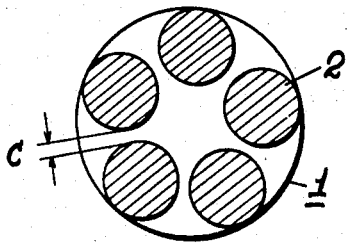
Fig. 2B
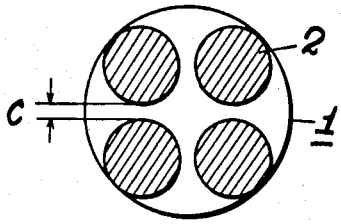
Fig. 3A
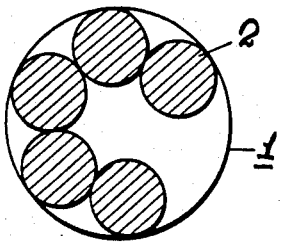
Fig. 3B
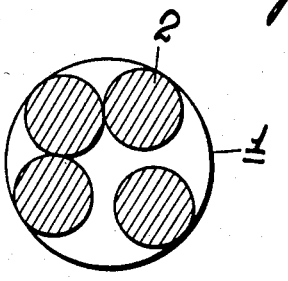

STEEL CORD

BACKGROUND OF THE INVENTION

1. Field of the Invention

This invention relates to an improvement of a steel cord for use as reinforcement of tires, belts, etc.

2. Prior Art

Generally, this kind of steel cord is composed by intertwisting a plurality of material wires into a strand, for example, as shown in FIG. 1A and FIG. 1B, a steel cord 1 is composed by intertwisting four or five of equal material wire 2. Then, a plurality of steel cords thus made are covered with a rubber compound as they are arranged in parallel state, for use as reinforcement of rubber of tires, belts, etc. Indispensable requirements when such steel cords are used as reinforcement are (1) good chemical adhesion of steel cords to a rubber compound and (2) good infiltration of the rubber compound into the central part of the steel cord, in other words, in order to enable the steel cord to perform its duties as reinforcement of a rubber structure, it is required that steel cords and rubber compound are formed into a perfectly integrated substance.

In the case where steel cords are used for tires, for example, poor adhesion of steel cords to the rubber compound and unsatisfactory penetration of the rubber compound into the central part of the steel cord cause separation of steel cords from rubber compound or the so-called "separation phenomenon" during the running of a car, with a resultant reduction of the function of tires. Moreover, material wires of steel cords get rusty due to moisture contained in the rubber compound, with the result of deterioration of cord strength to a large extent and earlier occurrence of the "separation phenomenon" mentioned above.

In order to eliminate the above disadvantages of the conventional steel cord, a steel cord with rubber compound infiltrating into its central part and covering the whole circumference of component material wires has been taken into consideration. This steel cord is a steel cord of soft twist 1 with a space C left between material wires 2 as shown in FIG. 2A and FIG. 2B.

In the case of the above-mentioned steel cord of soft twist, however, in order to have the rubber compound adhere to the whole circumference of each material wire and infiltrate into the central part of the steel cord in sufficient quantity, the space C between material wires must be large enough to permit the rubber compound to infiltrate through it or 0.02 mm at the least. However, a comparatively large space between material wires can cause unstable twist construction in the manufacturing of steel cords, for example, material wires 2 are one-sided and twist becomes uneven in lengthwise direction of a steel cord. In this case, even if the rubber compound penetrates into the central part of a steel cord, elongation under a very low load increases, with a bad influence upon the tire manufacturing operation. Moreover, when buckling took place at the steel cord, concentration of stress is caused with the result that plural material wires constituting a steel cord do not display their strength as an integrated substance and are affected by stress break much earlier.

SUMMARY OF THE INVENTION

The present invention has been made to eliminate the above-mentioned defects of the conventional steel cord and provides a steel cord composed of four material wires intertwisted, of which two material wires are struck to each other and intertwisted at the center and each of the other two material wires is arranged on both sides of the former two material wires with a certain space left between the former and the latter and the latter two material wires are twisted about the former two material wires in the same direction and at the same pitch as the former two material wires, into a steel cord. An object of the present invention is to improve infiltration of a rubber compound into the central part of the steel cord, to ensure perfect adhesion between the rubber compound and the steel cord, to check elongation at a very low load, to stabilize twist in lengthwise direction and to improve an anti-fatigue characteristic.

BRIEF EXPLANATION OF THE DRAWINGS

The nature and advantages of the present invention will be understood more clearly from the following description made with reference to the accompanying drawings, in which:

FIG. 1A, FIG. 1B, FIG. 2A, FIG. 2B, FIG. 3A and FIG. 3B show cross sections of the conventional steel cords, each being of different type;

DETAILED EXPLANATION OF THE INVENTION

Figure 4:
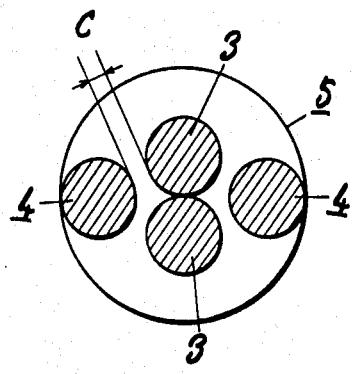
FIG. 4 is a cross section, showing an embodiment of the steel cord according to the present invention.

A preferred embodiment:

In FIG. 4, material wires 3 at the center are stuck to each other and intertwisted by S twist and at a twist pitch of 12.5 mm and two material wires 4 are arranged on both sides of the material wires 3, with a space C of around 0.10 mm left therebetween, and are twisted about the material wires 3 at the center in the same twist direction and at the same pitch as the material wires 3 into a steel cord 5. Diameters of the material wire 3 and the material wire 4 are 0.25 mm.

When the above steel cord 5 is stretched under the load of 5 kg., it shows elongation of about 0.3%, about half of the elongation shown by the conventional steel cord of the construction shown in FIG. 2 under the same condition. The comparison of load-elongation curves is shown in FIG. 5.

Figure 5:
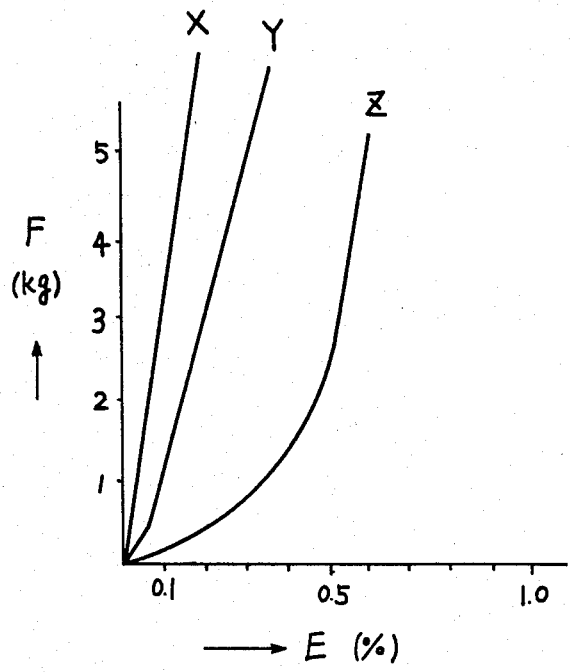
FIG. 5 is a curve showing the comparison between the conventional steel cord and a steel cord according to the present invention.

In FIG. 5 F represents a load and E represents elongation. X, Y and Z respectively represent the conventional steel cord shown in FIG. 1B, the steel cord according to the present invention shown in FIG. 4 and the conventional steel cord shown in in FIG. 2B.

The steel cord according to the present invention was covered with rubber compound and was tested by a three-pulley type fatigue tester, from which it was confirmed that the steel cord according to the present invention is about 1.2–1.5 times as long as the conventional steel cord in anti-fatigue life.

Regarding the material wires used for making the steel cord according to the present invention, those plated with copper alloy at the surface can be used so as to improve adhesion to a rubber compound. As to the twist pitch, twist pitches within the range from about 0.15 mm to about 0.5 mm are desirable. With regard to the space C between the material wires 3 stuck to each other at the center and the material wires 4 on both sides of the former, the space within the range from 0.02 mm to 0.15 mm is optimum. If the space C is smaller than 0.02 mm, even if rubber compound which shows good fluidity at pressing and vulcanizing is used, infiltration of the rubber compound into the spaces of steel cord worsens, with the result that adhesiveness between the steel cord and the rubber compound becomes poor and empty spaces are easy to be made inside. On the other hand, if the space is larger than 0.15 mm, elongation at a very small load increases and as a result, anti-fatigue cahracteristic and operational efficiency are worsened. Moreover, as the diameter of a steel cord becomes larger, such a problem that the thickness of a rubber sheet which covers the steel cords from top and bottom at tire shaping must be made larger.

An example of the method of manufacturing the steel cord according to the present invention is given below.

At first, two material wires 3 stuck to each other at the center are intertwisted and then material wires 4 are twisted about the material wires 3, as they are being given twist tendency by using pins, for example, into a steel cord.

Since the steel cord according to the present invention is composed as mentioned above, in the case where it is used as it is covered with a rubber compound, each component material wire can be covered perfectly with rubber compound and twist construction is stabilized, with resultant improvement of anti-fatigue characteristic, reduction in elongation at a low load and much improvement in operational efficiency at the processing of it with rubber. Regarding the operational efficiency, at the calender process for making steel cords and rubber into sheet form, in the case of conventional steel cord elongation in lengthwise direction is caused by stretching tension at a very low load and if the sheet making is effected as it is elongated, when stretching tension ceases to exist, rubber shrinks and the sheet will crease. This affects the operational efficiency and quality unfavorably. In the case of steel cord according to the present invention, such demerits are removed. Moreover, in the case of the steel cord according to the present invention, two material wires at the center become drag and keep the space from breaking and therefore uneven infiltration of rubber compound is eliminated.

As mentioned above, the steel cord according to the present invention has such advantages that it does not lower the operational efficiency at manufacturing of tires, belts, etc. and improves quality of tires, etc. to a great degree.

What is claimed is:

1. A steel cord composed of four material wires of the same diameter which are intertwisted, of which two material wires are stuck to each other and intertwisted at the center and each of the other two material wires is arranged on both sides of the former two material wires with a certain space left therebetween and the latter two material wires are twisted about the former two material wires in the same twist direction and at the same pitch as the former two material wires.

2. A steel cord as defined in claim 1, wherein the space between material wires is about 0.02 mm–0.15 mm.

* * * * *